US005404735A

United States Patent [19]

Hsieh

[11] Patent Number: 5,404,735

[45] Date of Patent: Apr. 11, 1995

[54] PADLOCK WITH BUILT-IN ANTI-THEFT ALARM DEVICE

[76] Inventor: Chen-Kuei Hsieh, No. 29, Lane 488, Section 2, Shing Ren Road, Chung Li City, Tao-Yuan Hsien, Taiwan, Prov. of China

[21] Appl. No.: 212,843

[22] Filed: Mar. 15, 1994

[51] Int. Cl.[6] ..... E05B 67/22; E05B 45/00

[52] U.S. Cl. ..... 70/38 A; 70/233; 70/416; 70/439; 70/441; 70/DIG. 49

[58] Field of Search ..... 70/38 A–38 C, 70/38 R, 35, 39, 51–53, 209, 233, 239, 225–227, 434, 435, 439, 441, DIG. 49, 416

[56] References Cited

U.S. PATENT DOCUMENTS

| | | | |
|---|---|---|---|
| 3,810,145 | 5/1974 | Gusaras | 70/DIG. 49 X |
| 4,328,692 | 5/1982 | Dice et al. | 70/441 X |
| 4,556,872 | 12/1985 | Masoncup et al. | 70/439 X |
| 4,624,120 | 11/1986 | Hoffman et al. | 70/DIG. 49 X |
| 4,658,611 | 4/1987 | Deacon | 70/434 X |
| 4,663,611 | 5/1987 | Humphrey | 70/DIG. 49 X |
| 4,811;578 | 3/1989 | Masoncup et al. | 70/439 X |
| 4,959,981 | 10/1990 | Davidson | 70/239 X |
| 5,023,596 | 6/1991 | Sirman et al. | 70/233 X |
| 5,194,845 | 3/1993 | Sirman et al. | 70/233 X |
| 5,199,282 | 4/1993 | Wang | 70/38 A |

FOREIGN PATENT DOCUMENTS

| | | | |
|---|---|---|---|
| 3943266 | 7/1991 | Germany | 70/233 |
| 8002961 | 12/1981 | Netherlands | 70/233 |

*Primary Examiner*—Peter M. Cuomo
*Assistant Examiner*—Suzanne L. Dino
*Attorney, Agent, or Firm*—Bacon & Thomas

[57] ABSTRACT

A padlock with a built-in anti-theft alarm device that is comprised of a padlock mechanism consisting of a lock structure having a rotational locking pintle bar that is revolved a certain angle to achieve locking and unlocking, a cam suitably positioned at the center of the pintle bar, an electric switch that is actuated by the cam pushing against a switching device, an alarm circuit with an independent power supply and a vibration sensor device. The rotation of the pintle bar revolves the cam such that the lobe pushes against and closes the electric switch, which initiates the operation of the alarm circuit. The vibration sensor device triggers the alarm circuit to emit an alarm sound whenever abnormal vibration is detected. The alarm circuit has an independent power supply that is securely protected by the outer padlock case to prevent damage and power loss. The key head of the padlock mechanism has a two-position rotating lock setting that can be selectively locked or unlocked with or without setting the alarm circuit for operation to prevent the unwanted sounding of the alarm.

4 Claims, 4 Drawing Sheets

BUZZ
L1
Q2
R11
C8
D4
R10
R12
Q1
R13
S1
C6
R9
D3
IC-3
R14
D5
R2
R1
C2
C1
IC-1
C3
R3
R4
S2
C7
R5
D1
R6
D2
R7
C4
IC-2
C5
R8

PADLOCK WITH BUILT-IN ANTI-THEFT ALARM DEVICE

BACKGROUND OF THE INVENTION

The invention herein is a padlock with a built-in anti-theft alarm device utilizing the rotation of a pintle bar revolving a cam such that the lobe pushes against and closes an electric switch which initiates the operation of an alarm circuit, while a vibration sensor device triggers the alarm circuit to emit an alarm sound whenever abnormal vibration is detected and thereby achieves the objectives of offering a durable lock with a built-in reverberating anti-theft alarm.

Since motorcycles and bicycles have the advantages of lightweight physical construction and high-speed capability, these vehicles have become the most popular type of transportation tools today. Based on the same reasons, motorcycles and bicycles are easily stolen and owners have resorted to a wide range of anti-theft measures, the most common being the wheel lock, an anti-theft method that consists of placing a padlock at the wheel of the vehicle, or the installation of an electronic anti-theft alarm connected to the electrical system of the vehicle. However, these two anti-theft measures often have the following shortcomings:

1. The installation of a padlock cannot easily anti effectively discourage thieves and, given the advanced techniques utilized by such persons, the padlock is often rendered ineffectual regardless of its precision and durability. With sufficient time and a complete set of tools, a highly skilled thief can pry a padlock open or simply break the padlock, a task which in a majority of cases is not difficult to achieve.
2. While a number of padlocks have anti-theft features, an organized group of thieves can disable the anti-theft capabilities by moving the vehicle to another location and covertly removing the padlock. Therefore, such enhanced padlock devices are useless in such a situation since it is impossible for the owner to be aware of the theft.
3. Electronic anti-theft alarms installed on vehicles are not only expensive in price, but only sound an alarm upon detecting vibration. Safer protection is still ensured by the fastening of a strong padlock. Therefore, the vehicle thief need only quickly access the wiring and cut the connection to the power supply to move the vehicle.

Based on the foregoing discussion, it must be acknowledged that most motorcycles and bicycles are not as costly in value as automobiles and, therefore, the higher price of automobile anti-theft devices makes them unfeasible for protecting motorcycles and bicycles. As a result, the motorcycle and bicycle padlocks or anti-theft alarms sold today each have respective protective functions and shortcomings that have lead to high rates of vehicle theft, making it necessary to improve such anti-theft methods.

SUMMARY OF THE INVENTION

In view of the shortcomings of the conventional motorcycle and bicycle anti-theft measures, the primary objective of the invention herein is to offer a kind of padlock that can be securely locked onto the wheel of a motorcycle or bicycle and which also has a built-in electronic anti-theft alarm device.

The secondary objective of the invention herein is to offer a kind of lightweight, structurally simple and low priced padlock with a built-in anti-theft alarm device that can also be transported practically on a motorcycle or bicycle and, furthermore, achieve ease of protection and purchase for the user.

Another objective of the invention herein is to offer a of padlock with a built-in anti-theft device that emits an loud volume alarm after the detection of abnormal vibration to alert and ward off the theft, thereby making it impossible for the thief to continue prying open the lock, while being resistant to sharp impact or other means of opening the padlock through damage and discouraging an organized group of thieves from planning vehicle removal, thereby offering a practical increase in protective effectiveness.

Yet another objective of the invention herein is to offer a padlock with a built-in anti-thief device that has an independent power supply and an alarm circuit that is securely protected inside the outer case of the padlock to prevent damage to the alarm circuit and the loss of electrical power.

Yet another objective of the invention herein is to offer a padlock with a built-in anti-theft device that has a two-position ON and OFF switch capability to enable the padlock to be locked without setting the anti-theft alarm function (such as when the padlock of the invention herein is being transported) by placing the switch in the first position to prevent the unwanted sounding of the alarm, thereby increasing the practicality of the invention herein.

The remaining objectives and functions of the invention herein shall be further explained in the attached drawings to enable the evaluation committee to develop a more detailed understanding, with the following detailed description referring to the most preferred embodiment of the invention herein without, however, any intent whatsoever to limit the rearm of the invention herein. Therefore, all identical patents applied for based on any embellishments or modifications whatsoever of and related to the invention herein shall be included within the scope, drawings and claims of the invention herein

DETAILED DESCRIPTION OF THE INVENTION

Figure 1:
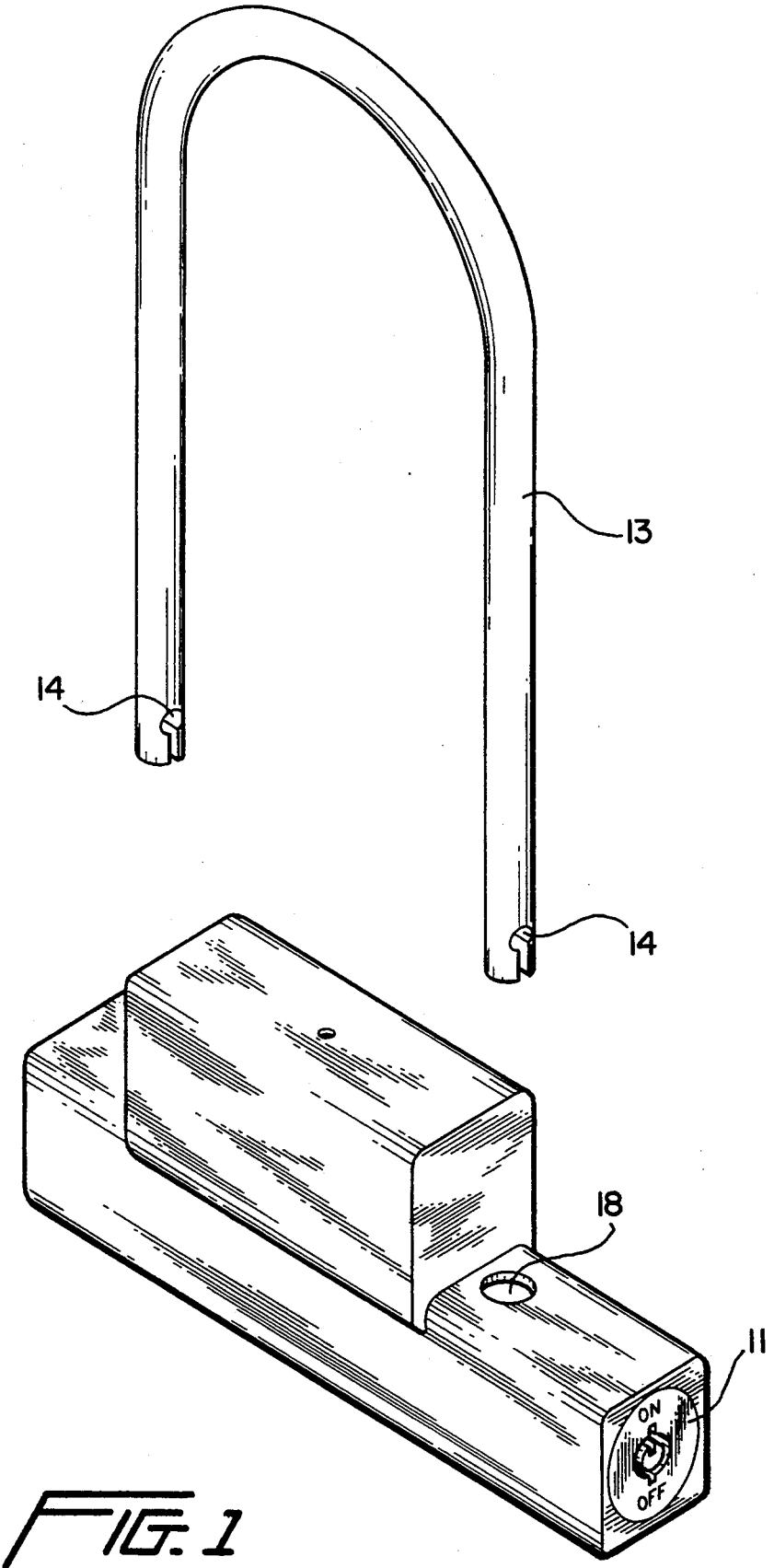
FIG. 1 is an exploded, perspective view of the invention herein.
Figure 2:
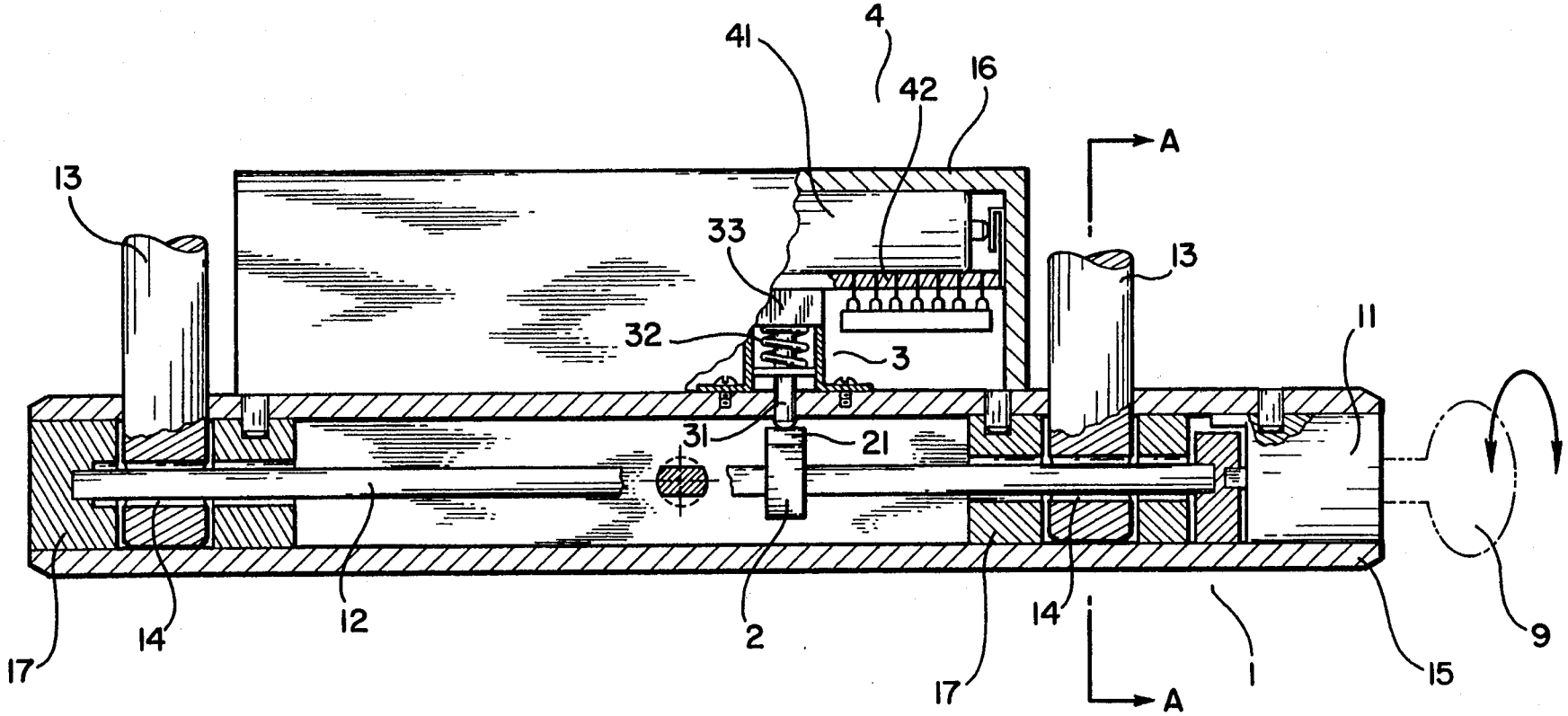
FIG. 2 is a chess-sectional drawing of the invention herein.
Figure 7:
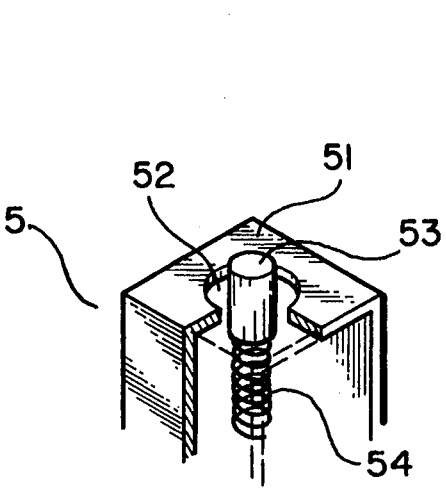
FIG. 7 is a perspective view, partially broken away of the vibration sensor device of the invention herein.
Figure 5:
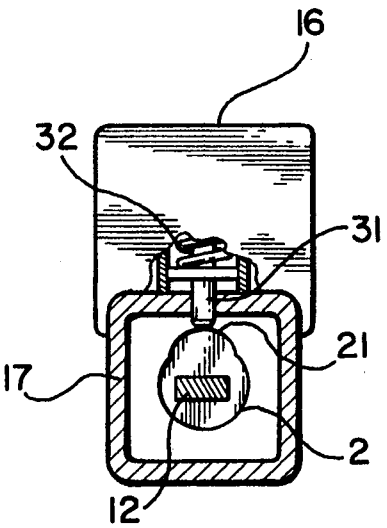
FIG. 5 is a cross-sectional drawing the invention herein when the padlock is locked and showing the protruding tip of the anti-theft alarm circuit in the standby position.
Figure 4:
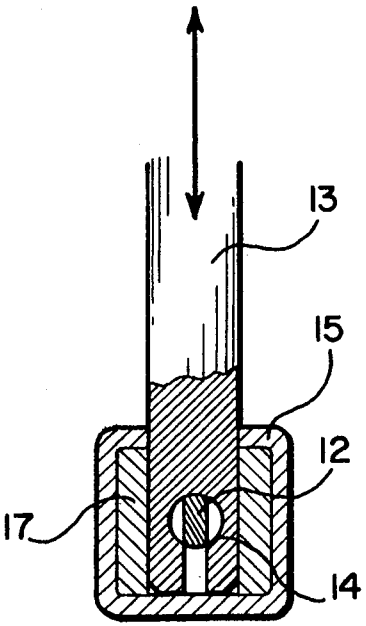
FIG. 4 is cross-sectional drawing similar to FIG. 3 of the key head of the invention herein when the padlock is unlocked.
Figure 3:
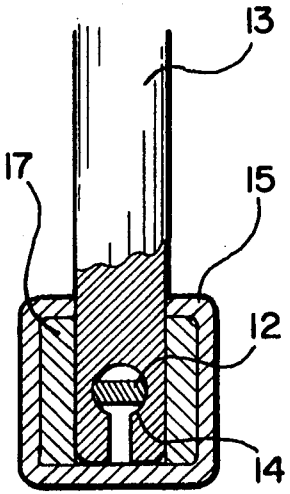
FIG. 3 is a cross-sectional drawing taken along line A–A' in FIG. 2 of the key head of the invention herein when the padlock is locked.
Figure 6:
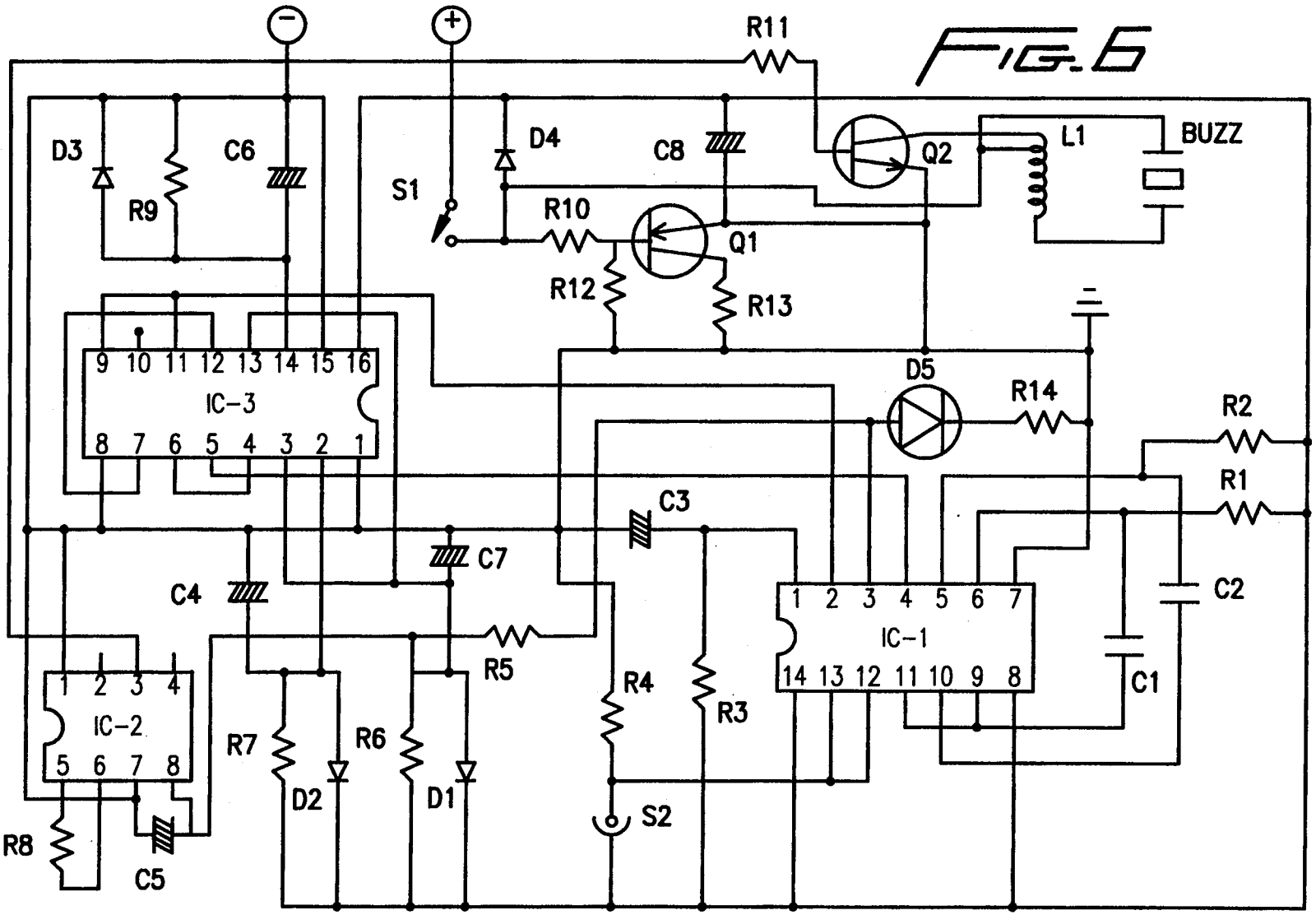
FIG. 6 is a schematic drawing of the anti-theft alarm circuit of the invention herein.

As indicated in FIG. 1 and FIG. 2, the preferred embodiment of the invention herein includes a padlock mechanism (1), a cam (2), a spring-loaded switch device (3), an alarm circuit (4) and a vibration sensor device (5); of which, the padlock mechanism (1) generally consists of a lock structure having a rotational locking pintle that is revolved to a certain angle to achieve locking and unlocking, wherein the key head (11) is a two-position (ON) and OFF) rotating barrel (rotated 90-degrees counterclockwise and clockwise to unlock) and the pintle bar (12) actuated by the key head (11) which consists of an eccentric shaft, wherein the pintle bar (12) is utilized to rotate in the latch hole (14) through the two ends of the shackle (13) to achieve the locking and unlocking function (as indicated in FIG. 3 and FIG. 4); there is a cam (2) suitably positioned at the center of the pintle bar (12) and there is a lobe (21) on the aforesaid cam (2); the base of tile spring-loaded switch device (3) is fastened by screws into the outer padlock case (15) at a point immediately above the cam (2) and the contact rod (31) tip is held outward the coil spring (32), with the front end of the coil spring (32) projecting towards the ramp of the cam (2) and the rear end of the coil spring (32) inserted into the receptacle of the trip-type electric switch (33) and, furthermore, the aforesaid switch is connected to alarm circuit (4) and triggers the alarm circuit (4); the alarm circuit (4) is mounted inside the control housing (16), which is fastened by screws to center of the outer padlock case (15), and he electronic component circuit layout is schematically illustrated in FIG. 6; the aforesaid alarm circuit (4) is electrically powered by batteries (41); in the alarm circuit (4), component A2 is a vibration sensor device (5) and the aforesaid vibration sensor device is connected to the sensor housing (51), which is of positive polarity and also soldered onto the circuit board (42); the sensor housing (51) has a sensor hole (52) through the upper surface and the sensor rod (53) of the aforementioned vibration sensor device is ensconced in a narrow coil spring (54) that becomes a conductor by soldering one end of the aforesaid coil spring onto the circuit board (42) which, furthermore, enables the exact centering of the sensor rod (53) through the sensor hole (52).

As referred to in the foregoing description of the structural assembly comprising the invention herein, after the two ends of the shackle (13) have been inserted into the shackle holes (18), the key (9) is turned clockwise to the indicated "ON" position which rotates the pintle bar (12) 90-degrees into the horizontal aspect and thereby causes the engagement with the latch hole (14) and the achievement of the locking function (as indicated in FIG. 3) and, furthermore, the rotation of the pintle bar (12) revolves the ramp of the cam (2) such that the lobe (21) pushes against the tip of the contact rod (31), while the other end of the contact rod (31) closes the electric switch (33), which initiates the operation of the alarm circuit (4) and the general description of the aforesaid operation is as follows: (Refer to FIG. 6)

1. When the electric switch (33) S1 is in the "ON" position, positive current flows through the electric switch SI to the transistor Q1 and diode D4 as well as to pin 8 and pin 14 of the integrated circuit IC-1 and pin 16 of the integrated circuit IC-3, at which time the integrated circuits IC-1 and IC-3 start to function.
2. When the padlock of the invention herein is subjected to vibration, the sensor rod (53) swings and contacts the inner circumference of the sensor hole (52) (equivalent to S2 in the "ON" mode), thereby enabling positive voltage to enter pin 12, pin 13 and pin 11 of the integrated circuit IC-1, which is then converted from a high voltage state to a low voltage state and inputted to pin 9 and pin 6; output at pin 10 is converted from a low voltage state to a high voltage state and conducted through the capacitor C2 to pin 5, where the high voltage state is converted to a low voltage state and the output at pin 6 is converted from a high voltage state to a low voltage state, wherein the outputs at pin 5 and pin 6 are again conducted to pin 4, converted from the low voltage state to a high voltage state, and conducted to pin 5 of the integrated circuit IC-3; output at pin 2 is converted from a high voltage position to a low voltage position and then conducted through the capacitor C4 and the resistor R7 which, after a show electrical charge of approximately seven seconds, the outputs at pin 9 and pin 10 are converted from a high voltage position to a low voltage position and conducted to pin 2 of the integrated circuit IC-1; the output at pin 3 is converted from the low voltage position to a high voltage position and conducted through The resister R5 to pin 5 of the integrated circuit IC-2, of which the capacitor C5 is the current filter.
3. The integrated circuit IC-2 is a siren-type sound producing chip, of which the basic pulse originates from pin 7 and pin 8 on through the resistor R8 and then passes back into the integrated circuit and output as an audio signal through pin 3, the resistor R11 and the base of the transistor Q2; after amplification in the transistor Q2, the aforesaid signal is outputted at increased intensity to the coil L1 and then emitted as a dual-tone siren through the connected buzzer BUZZ.
4. When the integrated circuit IC-3 is in the alarm mode, the output at pin 14 is converted from a high voltage state to a low voltage state, wherein the slow voltage state conversion period is controlled by the electrical charging rate of the resistor R9 and the capacitor C6, causing the siren to sound for approximately 16 seconds.
5. The electric switching duration is controlled by the electrical charging rate through the resistor R6 and the capacitor C7 from pin 3 and pin 13 of the integrated circuit IC-3, and the electrical switching duration is approximately eight seconds.
6. The diodes D1, D2, D3 and D4 prevent pulsating current from internally damaging the integrated circuits.
7. The diode D5 is a light-emitting diode and the resistor R14 is the voltage-drop current limiter of D5.

Based on the foregoing description of the alarm circuit (4), when the padlock with built-in alarm of the invention herein is locked, the alarm circuit (4) invokes a "whistle-like" tone through the buzzer BUZZ and Then enters the anti-theft standby mode after approximately eight seconds; a high volume alarm sound is emitted approximately seven seconds after the sensing of abnormal vibration for a period of approximately 16 seconds to startle the thief and warn the vehicle owner, and the alarm circuit (4) reverts to the anti-theft standby mode following the aforesaid 16-second alarm.

When the owner unlocks the invention herein, the key (9) is turned counter-clockwise and the pintle bar (12) rotates 90 degrees into the vertical position, thereby causing the pintle bar (12) to disengage the latch hole (14) (as indicated in FIG. 4) and, furthermore, causes the lobe (21) along the ramp of the cam (2) to revolve away from the tip of the contact rod (31), which switches off the electric current supply and terminates the operation of the alarm circuit (4).

Furthermore, the invention herein can be locked without setting the anti-theft alarm function to accommodate the needs of the user; for example, when the padlock of the invention herein is transported with the shackle (13) inserted into the outer padlock case (15), the key (9) can be turned counter-clockwise to the indicated "OFF" position so that although the pintle bar (12) is rotated into the horizontal aspect locking the latch hole (14), the lobe (21) along the ramp of the cam (2) does not push against the tip of the contact rod (31) to prevent the alarm from sounding and causing inconvenience.

Another feature worthy of note is that since the alarm circuit (4) of the invention herein is securely positioned and protected inside the outer padlock case (15) and utilizes an independent power supply, the alarm circuit (4) is safeguarded from damage and loss of a power source. With these capabilities integrated into a single product, the invention herein constitutes an innovative type of structure offering combined anti-theft and padlock functions, a product which has never been observed before. Furthermore, the invention herein is of total practical value and therefore fully meets the requirements for the granting of new patent rights as legally defined and is herein duly presented in application thereof.

What is claimed is:

1. A padlock with a built-in anti-theft alarm comprising:

a padlock mechanism consisting of a lock structure having a rotational locking pintle bar that is revolved to achieve locking and unlocking;

a cam having a lobe positioned on the center of the pintle bar;

an alarm circuit powered by an independent power supply;

a spring-loaded electric switch device located at a point immediately above the cam having a contact rod tip biased outward by a coil spring, with a first end of the coil spring projecting towards the cam and a second end of the coil spring inserted into a housing of the electric switch and, means connecting the switch to the alarm circuit such that movement of the contact rod triggers the alarm circuit; and, a vibration sensor device; wherein the rotation of the pintle bar revolves the cam such that the lobe pushes against the contact rod and closes the electric switch, which initiates operation of the alarm circuit, and the vibration sensor device triggers the alarm circuit to emit an alarm sound whenever abnormal vibration is detected.

2. The padlock as described in claim 1 further comprising a key head of the padlock mechanism having a two-position rotating lock setting that can be selectively locked and unlocked without setting the alarm circuit for operation in a first position and with setting the alarm in a second position, 3. The padlock as described in claim 1 wherein a switching duration of the alarm circuit is controlled by an electrical charging rate through a resistor and a capacitor from pins of an integrated circuit.

4. The padlock as described in claim 1 wherein the alarm circuit utilizes an integrated circuit to control the duration of the sounded alarm, wherein the output at a pin is converted from a high voltage state to a low voltage state and the low voltage state conversion period is controlled by the electrical charging rate of a resistor and a capacitor.

* * * * *